United States Patent [19]

Lenk

[11] Patent Number: 4,493,628

[45] Date of Patent: Jan. 15, 1985

[54] MELT SPINNING APPARATUS

[75] Inventor: Erich Lenk, Remscheid, Fed. Rep. of Germany

[73] Assignee: Barmag Barmer Maschinenfabrik AG, Remscheid, Fed. Rep. of Germany

[21] Appl. No.: 512,937

[22] Filed: Jul. 12, 1983

[30] Foreign Application Priority Data

Jul. 15, 1982 [DE] Fed. Rep. of Germany ..... 3226479
Oct. 22, 1982 [DE] Fed. Rep. of Germany ..... 3239064

[51] Int. Cl.[3] ..... B29F 3/04
[52] U.S. Cl. ..... 425/192; 425/198
[58] Field of Search ..... 425/725, 382.2, 197, 425/192 S, 198; 264/176 F

[56] References Cited

U.S. PATENT DOCUMENTS

| | | | |
|---|---|---|---|
| 2,786,504 | 3/1957 | Samler | 425/198 |
| 2,838,084 | 6/1958 | Samler | 425/198 |
| 3,500,499 | 3/1970 | Goossens | 425/198 |
| 3,559,237 | 2/1971 | Biggelaar et al. | 425/192 S |
| 3,762,854 | 10/1973 | Kilsdonk | 425/464 |
| 4,050,866 | 9/1977 | Kilsdonk | 425/464 |
| 4,285,651 | 8/1981 | Fetchu et al. | 425/464 |
| 4,321,228 | 3/1982 | Kok | 425/197 |
| 4,413,968 | 11/1983 | Bliss | 425/198 |

*Primary Examiner*—Jay H. Woo
*Assistant Examiner*—Michael McGurk
*Attorney, Agent, or Firm*—Bell, Seltzer, Park & Gibson

[57] ABSTRACT

A melt spinning apparatus is disclosed which is adapted for forming a plurality of synthetic filaments from a molten polymer. The apparatus comprises a spin block composed of a spin plate having a plurality of transverse ducts, a cover plate overlying the spin plate, and a cavity formed between the two plates and communicating with the ducts for receiving the molten polymer. A pair of side plates are disposed along respective opposite sides of the block, and the block and side plates include mating inclined contact surfaces whereby tightening of the side plates against the block causes the spin plate and cover plate to be pressed toward each other, whereby a seal is formed between the plates which prevents leakage of the molten plastic from the cavity.

16 Claims, 6 Drawing Figures

MELT SPINNING APPARATUS

The present invention relates to a melt spinning apparatus of the type adapted for dividing a molten polymer into a plurality of streams to form synthetic filaments or threads.

A melt spinning apparatus is described in U.S. Pat. No. 3,762,854 and German OLS No. 2,117,130, which is composed of a rectangular block including a spin plate having multiple holes for extruding polymers into filaments, and a cover plate overlying the spin plate so as to form a cavity therebetween. Side plates are positioned along opposite sides of the block, and cooperating dovetail guides interconnect the sides of the block and the side plates. Further, a threaded interconnection is provided between the spin plate and cover plate so that the two plates may be moved apart to secure the dovetail interconnection, or moved together to release the interconnection and permit disassembly of the block. A band-like sealing ring is disposed about the periphery of the cavity to prevent the loss of the polymer melt when the spin plate and cover plate are moved apart by the threaded interconnection.

In the extrusion of melts of high polymer plastics, very high pressures, on the order of 200 bars or more, are present in the plastic melt delivered to the spinning apparatus. As a result, a spin block of the type described in the above patents must be provided with a seal at the side plates which not only reliably withstands these high pressures, but also will continue to be absolutely tight during startup when the pressure is low, as well as during repeated changes of pressure which may for example occur from shutdowns of the operation. Also, the seal must meet further exacting requirements, such as resistance to high temperature since the extrusion temperature of many melts may reach about 300 degrees C. Further, it has been found that once a leak has occurred during the operation of the spin block, it can not readily be stopped.

In the spinning assembly of the above described patents, such requirements are not fulfilled, because the holding arrangement for the spin plate and cover plate is not in a position to effect a seal for different loads at all operating conditions of the melt spinning apparatus.

It is accordingly an object of the present invention to provide a melt spinning apparatus which avoids the above noted leakage problems associated with known apparatus of this type.

It is a more particular object of the present invention to provide a melt spinning apparatus which includes a holding arrangement for the spin plate and cover plate which provides a permanent seal therebetween, and which remains tight under changing operating temperatures and pressures, to thereby avoid leakage.

These and other objects and advantages of the present invention are achieved in the embodiments illustrated herein by the provision of a melt spinning apparatus which includes a generally rectangular spin block composed of a spin plate having a plurality of ducts extending therethrough, and an overlying cover plate. The spin plate and cover plate have opposing inner faces defining a transverse plane therebetween, and oppositely directed outer faces. The block further includes cavity means disposed between the opposing inner faces of the spin plate and cover plate, and communicating with the ducts in the spin plate, so as to be adapted for supplying a molten polymer or the like thereto.

A pair of side plates are disposed along respective opposite sides of the spin block, and means are provided for mounting the side plates to the spin block such that the side plates may each be moved in a lateral direction toward or away from the associated side of the spin block. In addition, the apparatus includes cooperating surface means on the spin block and side plates for causing the spin plate and cover plate to be pressed toward each other upon the side plates being laterally moved in a tightening direction by the side plate mounting means, to thus oppose the tendency of the plates to separate by reason of the pressure of the molten polymer in the cavity means, and thereby avoid leakage.

In the illustrated embodiments of the invention, the cooperating surface means takes the form of a side edge surface portion extending along each of the two outer side edges of each outer face of the block, with the two side edge surface portions of at least one of the outer faces being included in opposite directions and at substantially equal angles with respect to the transverse plane defined by the opposing inner faces of the spin plate and cover plate. Also, each of the side plates is provided with contact surfaces which overlie and conform to the inclination of respective ones of the side edge surface portions.

In one preferred embodiment, the two side edge surface portions on both of the outer faces of the spin block are inclined in opposite directions with respect to the transverse plane, and the two side edge surface portions along each side of the block are inclined in opposite directions to define a wedge-like configuration in cross section. In another embodiment, the two side edge surface portions along each side of the block are inclined in the same direction, and the side plates are joined by at least one threaded member extending laterally between the plates and beyond one of the outer faces of the block.

With regard to the degree inclination of the side edge surface portions of the spin block and the contact surfaces of the side plates, it is advantageous that an angle of inclination be selected which has a tangent not greater than the friction coefficient of the materials of the block and side plates. Preferably, the angle of inclination may be somewhat less so that its tangent is less than such friction coefficient. By this arrangement, a self-locking effect is achieved, which means that the tightening screws are not additionally loaded by the pressure forces of the melt. However, even if the tangent of the angle of inclination is greater than the friction coefficient of the materials of the block and side plates, only relatively small components of the melt pressure force become effective on the tightening screws. In any case, when choosing the angle of inclination, one should consider which tightening arrangement is required, so that there may be considered a compromise between the requirements for a small tightening force on the tightening screws resulting from the pressure of the melt on the one hand, and to the desired shortness of the tightening distance of the spin block and side plates on the other hand. Where the tangent of the angle is greater than the coefficient of friction of the materials of the spin block and side plates, it is preferable that an angle be selected which has a tangent not greater than 0.3. The effect of such an angle is that only a small part of the forces for tightening the spin block become effective on the screws and the screws may be dimensioned to accommodate only these smaller forces.

The wedge-shaped inclination of the side edge surface portions of the block, and of the contact surface of the side plates, results in the side plates applying the high force needed for sealing the inner faces of the spin plate and cover plate, when the side plates are moved in the direction of tightening. There are several other constructional possibilities for the design of the cooperating surface means, as further described below.

Some of the objects having been stated, other objects and advantages will appear as the description proceeds, when taken in conjunction with the accompanying drawings in which FIG. 1 is a cross sectional view of a melt spinning apparatus which embodies the features of the present invention;

Figure 1:
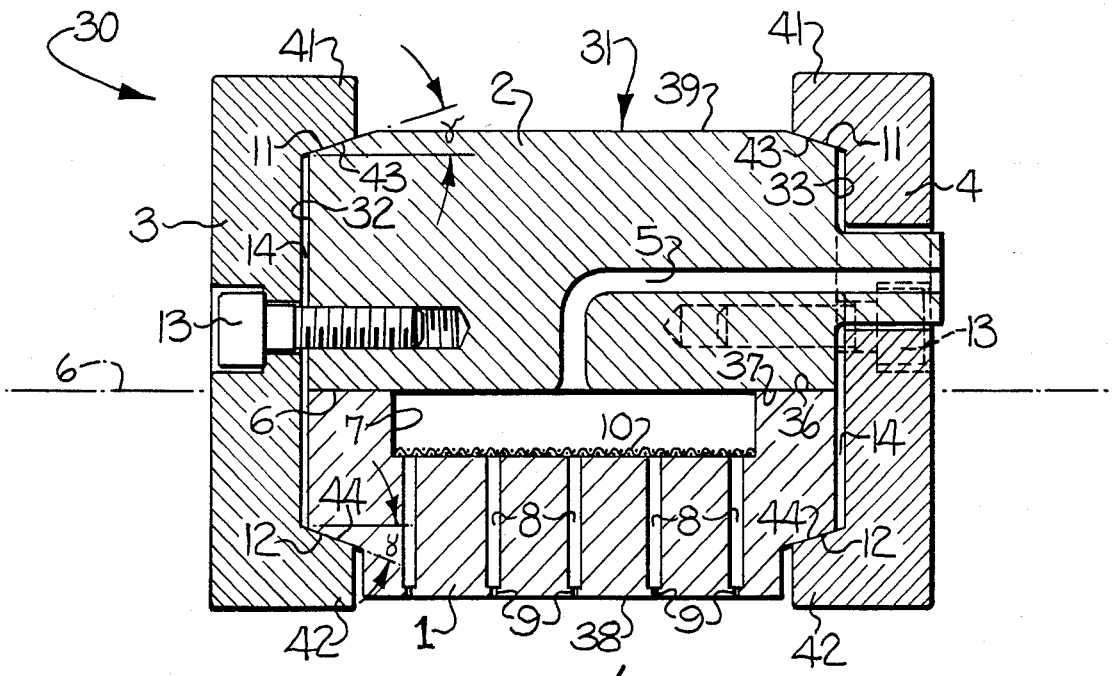
Figure 3:
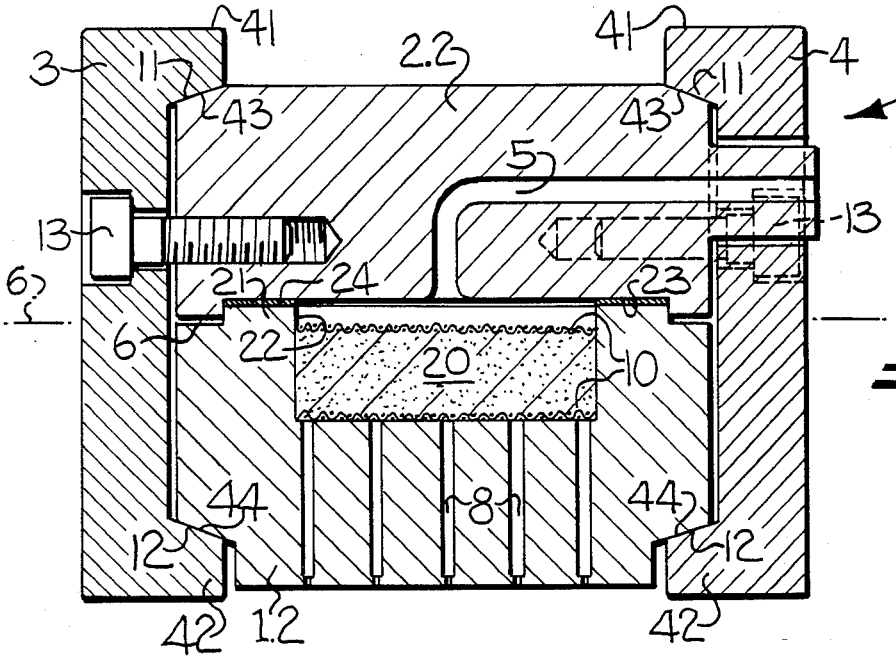
FIG. 3 is a cross sectional view of still another embodiment, and which is provided with a sand filter placed in the cavity of the spin block.
Figure 4A:
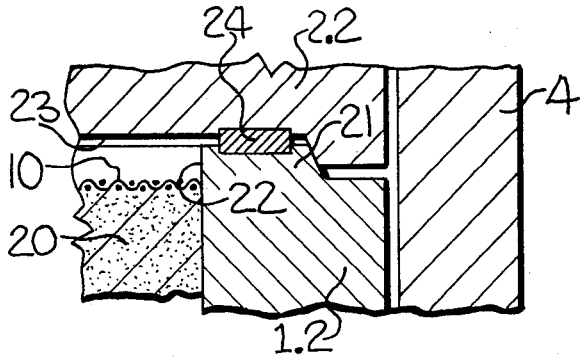
Figure 4B:
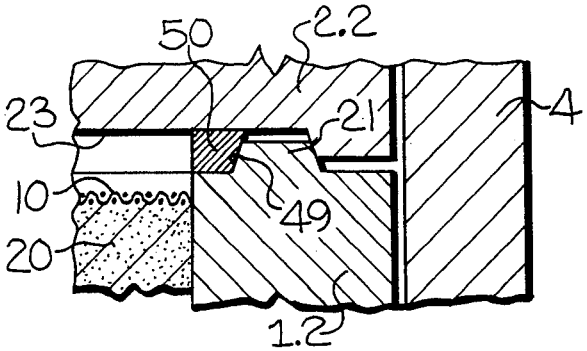
Figure 5A:
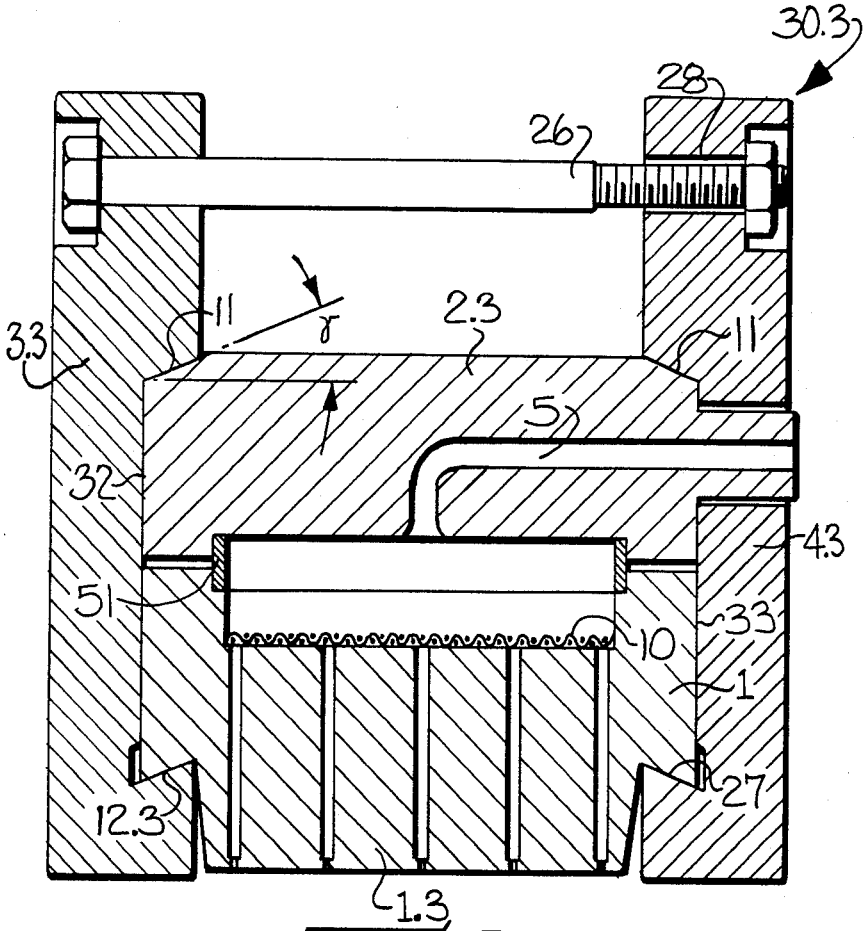
Figure 5B:
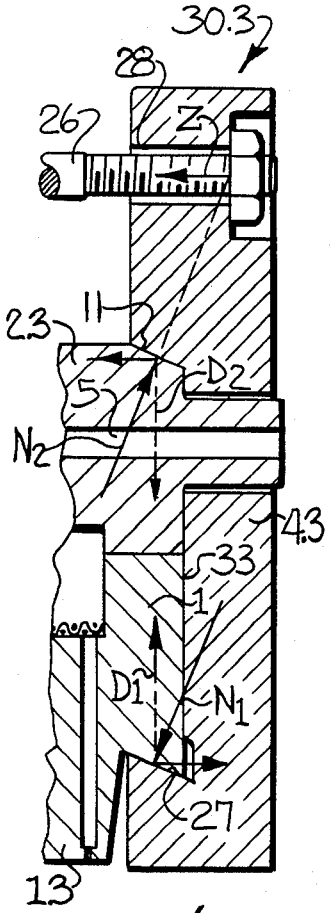
Figure 6:
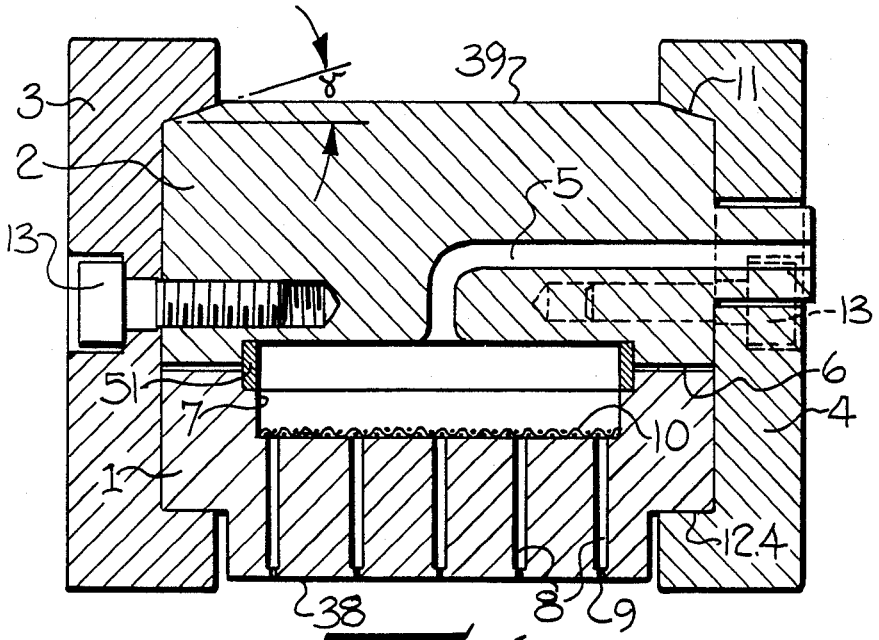

FIG. 4*a* is an enlarged fragmentary sectional view of the spinning apparatus shown in FIG. 3, but which is modified to provide for the centering of the sealing surfaces between the spin plate and cover plate;

FIG. 4*b* is a view similar to FIG. 4*a* but with a modified sealing member;

FIG. 5*a* is a cross sectional view of an apparatus generally similar to that shown in FIG. 1, but which is modified to include correspondingly inclined contacting surfaces on each side of the block, and a through bolt disposed above the cover plate for securing the side plates to the block;

FIG. 5*b* is a fragmentary cross sectional view of a portion of FIG. 5*a*; and FIG. 6 is a cross sectional view similar to that shown in FIG. 1, but wherein the contacting surfaces on one outer face are parallel to a transverse plane through the apparatus.

Referring more specifically to the drawings, FIG. 1 illustrates a melt spinning apparatus 30 which embodies the features of the present invention. The apparatus 30 may be used, for example, in synthetic filament spinning operations, and it is preferably installed in groupings, called spin beams, to provide several spinning positions. In these operations, the polymer material is usually plasticized or melted in a screw-type extruder, discharged through a subsequent metering pump, such as a gear pump, and delivered to the spin beam in metered quantities through a heated melt distribution conduit to each individual spinning apparatus. The distribution conduit communicates with the conduit 5 of the apparatus as seen in FIG. 1.

The apparatus 30 comprises a generally rectangular spin block 31 having two opposite sides 32, 33, with the block 31 being composed of a spin plate 1 having a plurality of ducts 8 extending vertically therethrough, and a cover plate 2 overlying the spin plate. The spin plate and cover plate have opposing inner faces 36, 37 defining a transverse separating plane 6 therebetween, and oppositely directed outer faces 38, 39 respectively. Cavity means in the form of a chamber 7 in the inner face of the spin block is disposed between the opposing faces, and communicates with the ducts so as to be adapted for supplying a molten polymer or the like thereto. The distribution conduit 5 also communicates with the chamber 7 for delivering the molten polymer from the extruder.

The vertical ducts 8 through the spin block proceed from the chamber 7 to the outer face 38 and communicate with the actual spinning holes 9. Spinning holes 9 may have different cross sectional configurations, hole diameters, and hole patterns. Several layers of wire screen 10 with a stepped mesh width serve to filter the plasticized molten material and prevent the spinning holes 9 from becoming clogged.

The outer face 39 of the cover plate 2 includes a side edge surface portion 11 extending along each of the two side edges thereof, and the outer face 38 of the spin plate 1 includes two side edge surface portions 12 extending along each of the two side edges thereof. The two side edge surface portions 11 are inclined in opposite directions and at equal angles (gamma) with respect to the transverse plane 6, and the two side edge surface portions 12 are also inclided in opposite directions and at equal angles with respect to the transverse plane. Further, the two side edge surface portions along each side of the block, e.g. the portions 11 and 12 at side 33, are inclined in opposite directions to define a wedge-like configuration in cross section and as illustrated in FIG. 1.

The spinning apparatus further includes a pair of side plates 3, 4 disposed along respective opposite sides 32, 33 of the spin block. Each of the side plates includes a pair of laterally extending shoulders 41, 42, and each shoulder has a contact surface 43, 44 overlying a respective side edge surface portion 11, 12 of the adjacent spin plate and cover plate. Thus for example, the contact surface 43 of the shoulder 41 overlies the side edge surface portion 11, and the contact surface 44 of the shoulder 42 overlies the side edge surface portion 12. In addition, the contact surfaces 43, 44 of the shoulders conform to the inclination of the associated side edge surface portions 11, 12.

The side plates 3, 4 are mounted to the spin block by an arrangement whereby the side plates may each be moved in a lateral direction toward or away from the associated side 32 or 33 of the block. Also, upon such lateral movement in a tightening direction, the inclined side edge surface portions 11, 12 and cooperating contact surfaces 43, 44 act to press the opposing inner faces 36, 37 of the spin plate and cover plate toward each other and thus oppose the tendency of the plates to separate by reason of the pressure of the molten polymer or the like in the chamber 7, and the thereby avoid leakage.

In the embodiment of FIG. 1, the spin block 1 is pressed together by both shoulders 41, 42 of each side plate, and the side plates are secured to the cover plate 2 by several tightening screws 13. According to the invention, the two side edge surface portions 11 or 12 of at least one of outer faces 38 or 39, and the associated contact surfaces 43, 44 on the side plates, are inclined in opposite directions with respect to the transverse plane 6. Further, the wedge angle gamma, which is defined as the angle between the side edge surface portions and the transverse plane 6, is selected so that its tangent is not greater than the friction coefficient of the materials of the spin plate 1 or cover plate 2 on the one hand, and the supporting shoulder 41 or 42 on the other hand, when these components are mated with each other.

Referring again to the embodiment of FIG. 1, the two side edge surface portions 11, 12 along each side 32, 33 of the block are inclined in opposite directions to define a wedge-like configuration in cross section. Thus when the screws 13 are tightened, the spin block 31 is centered between the two side plates 3 and 4. In so locking the spin block together, there is present a distribution of forces wherein the supporting shoulders 41 and 42 first slide along the side edge surface portions 11, 12 of the spin block, until the spacing of the members at the transverse plane 6 diminishes due to the force components effective in the vertical direction, and a continuous seal is formed at the transverse plane 6. It will be noted that a gap 14 is present between the side plates 3, 4 and the sides 32, 33 of the spin block, which permits the locking function to occur.

Figure 2:
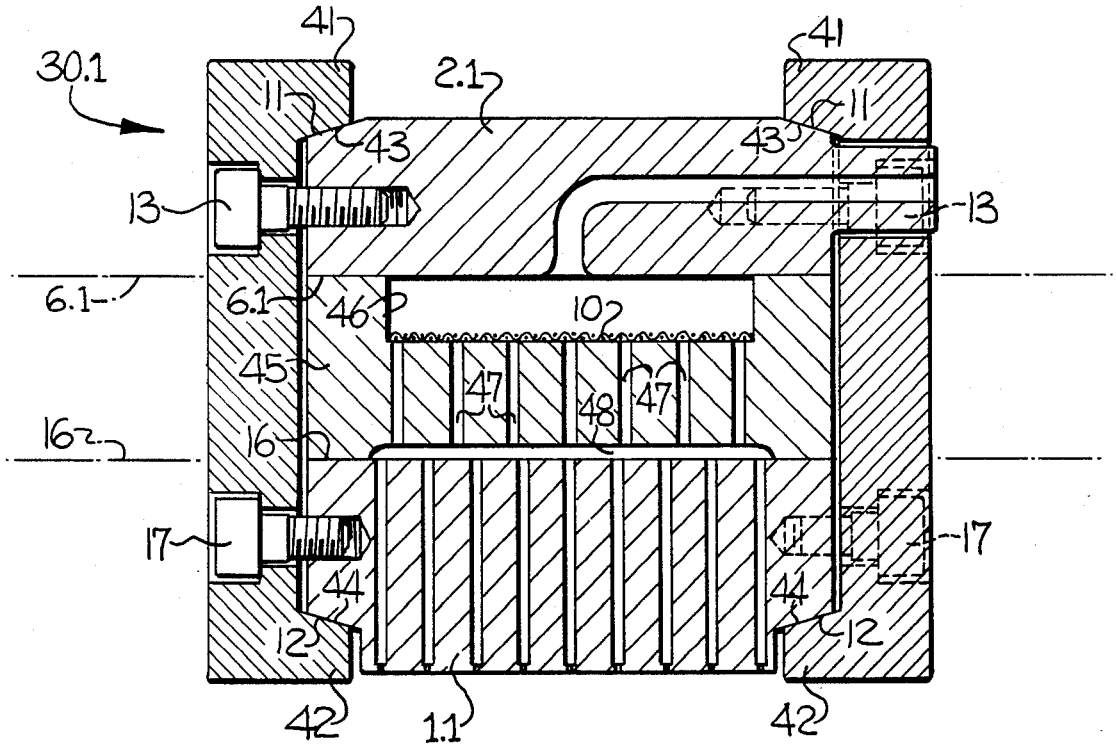
FIG. 2 is a cross sectional view of a second embodiment of the invention, and which includes a distributor plate in the spin block.

FIG. 2 illustrates a melt spinning apparatus 30.1 which is generally similar to the embodiment of FIG. 1, but which includes a separate filter block 45 positioned between the spin plate 1.1 and cover plate 2.1. The filter block 45 includes the chamber 46 and a plurality of vertical ducts 47, which communicate with a space 48 adjacent the inner face of the spin block 1.1. A first transverse separating plane 6.1 is thus formed between the cover plate 2.1 and the filter block 45, and a parallel second transverse separating plane 16 is formed between the block 45 and spin plate 1.1. Further, in this embodiment, the side edge surface portions 11, 12, and the contact surfaces 43, 44 of the supporting shoulders 41, 42 have a wedge-shaped inclination in the direction of tightening of the screws 13 and 17. It will be understood however that in all of the embodiments disclosed herein, the upper pair of side edge surface portions 11, or the lower pair of side edge surface portions 12, and their respective mating contact surfaces on the shoulders, may be disposed parallel to the separating plane 6 (note FIG. 6), or be inclined in the same direction as the other pair of side edge surface portions and mating contact surfaces (note FIG. 5*a*).

In the embodiment of FIG. 2, the cover plate 2.1 is locked together with side plates 3 and 4, upon tightening of the bolts 13, and as a result of the wedging effect of the upper supporting shoulders 41, the cover plate 2 is pressed vertically against the filter block 45. Upon bolts 17 being tightened, the wedging effect of the lower supporting shoulders 42 causes the spin plate 1.1 to be pressed against the filter block 45, so that initially the structural members of the spin block are centered, and then the vertical force components become effective in both transverse separating planes 6.1 and 16 to prevent leakage in these separating planes. If desired, cooperating deformable seals (not shown) may be provided at each of the separating planes to facilitate the sealing function.

The melt spinning apparatus 30.2 of FIG. 3 differs from the embodiment of FIG. 1 in that the spin plate 1.2 includes a cup-shaped recess 22 which is rectangular in cross section. This recess is enlarged so that it serves as a chamber for a sand filter 20 which is covered by several layers of wire screen 10 with a stepped mesh width. In order to adequately stabilize the walls of the chamber 22, a projecting tongue 21 extends about the chamber 22 and upwardly beyond the separating plane 6. The outer side edge of the raised tongue 21 engages the inner side edge of a conforming recess 23 provided in the cover plate 2.2 upon the inner faces being moved together, and this interengagement stabilizes the wall of the chamber 22 so that it cannot bulge laterally. A continuous seal 24 prevents leakage of the plasticized material from the chamber 22 when the inner faces are pressed together.

The sand filter 20 preferably extends over the entire length of the rectangular spin plate 1.2, so that the circumferential tongue 21 is rectangular with rounded edges; however, it may be sufficient if the projecting tongue 21 only extends along the longitudinal side of the spin plate 1.2 for increasing the resistance against bending of the side walls of chamber 22 for the sand filter 20. With regard to the design of the side plates 3 and 4, and their supporting shoulders, as well as the locking and sealing of the members forming the spin block, reference is made to FIGS. 1 and 2.

FIG. 4*a* shows a modification of the melt spinning apparatus of FIG. 3, by the addition of centering means formed between the spin plate 1.2 and cover plate 2.2. This additional centering means is provided by forming the mating lateral side edges of the tongue 21 and recess 23 to be correspondingly inclined in cross section in a wedge-shaped manner. Thus when the inner faces of the spin plate and cover plate are pressed together, the plates will become centered with respect to each other. The inclination of the engaging surfaces is preferably within the range of self-locking.

The modification of FIG. 4*b* differs from the embodiment of FIG. 4*a* essentially insofar as the projecting tongue 21 has a recess 49 at that side which is adjacent the chamber 22 for the sand filter 20. Into this recess, a preferably closed annular sealing element 50 is inserted which abuts against the wall of the recess. Preferably, a preformed annular band made from a plastically deformable sealing material is utilized, which provides a self-adjusting seal with respect to the high pressure of the melt.

The apparatus 30.3 illustrated in FIG. 5*a* is generally similar to the embodiment of FIG. 1, with the exception that the lower side edge surface portions 12.3 on the spin plate 1.3 are inclined in the opposite direction from that shown in FIG. 1. More particularly, in the embodiment of FIG. 5, the two side edge surface portions 11, 12.3 along each side of the block are inclined in the same direction. The cooperating contact surfaces of the supporting shoulders are correspondingly inclined, and the two side plates 3.3 and 4.3 are interconnected by at least one threaded member 26 which extends laterally between the side plates and in spaced relation above the outer face of the cover plate 2.3. Since the contact surfaces of the upper supporting shoulders of the side plates are inclined in the tightening direction of the threaded member 26, the tightening of the member 26 results in a vertical force component being applied to the side edge surface portions 11, which acts to seal the chamber 7 between the spin plate 1.3 and cover plate 2.3. It should be noted that in this embodiment the side plates 3.3 and 4.3 lie against the two opposite sides 32 and 33 of the spinning block without any gap 14. Thereby, a good heat transfer can additionally be attained for heating the spin block and especially the spin plate 1.3 with its plurality of ducts 8 and spinning holes 9. For achieving this effect, the seal 51 in the transverse plane 6, e.g. between the spin plate 1.3 and the cover plate 2.3, has been modified.

With regard to the clamping of the spin block as shown in FIG. 5*a*, it should further be noted that it is desirable that the stress on the plates 3.3 and 4.3 be applied so as not to bend the plates. This may be accomplished by coordinating the selected wedge angles gamma and the spacing of the bores 28 for the threaded members 26 above the spin block. It should further be noted that with the specified dimensioning of the wedge angle gamma on the side edge portions 11 and 12.3, a self-locking effect is achieved, and that when the operating pressure becomes effective, the initially stressed side plates are no longer able to slide from the corresponding side edge portions of the spin block, so that it is not necessary to increase the forces by retightening the screws 13, 17, or threaded member 26. This advantage applied to all embodiments.

As seen in FIG. 5*b*, the distance between the side edge surface portion 11 and the bores 28 in the side plates 3.3, 3.4 is chosen such that the line N, which is normal to the side edge surfaces 11, meets the center line of the tightening member 26 just where the nuts or heads of such members abut against the side plates for inducing the tensioning forces Z. The vertical component of N2 is D2, which force effects the compression of the spin block, and together with the opposite force D1 at the surface 12.3, results in the sealing of the spin block from leakage of the pressurized melt.

In the embodiment of FIG. 6, the two side edge portions 11 on the outer face 39 are inclined in opposite directions with respect to the transverse plane 6, and the two side edge surface portions 12.4 on the outer face 38 are substantially parallel to the transverse plane. Also, the sealing member 51 is of the type illustrated in FIG. 5*a*.

In the drawings and specification, there have been set forth preferred embodiments of the invention, and although specific terms are employed, they are used in a generic and descriptive sense only and not for purposes of limitation.

That which is claimed is:

1. A melt spinning apparatus adapted for dividing a molten polymer into a plurality of streams to form synthetic filaments, and characterized by the substantial absence of leakage of the polymer, and comprising a generally rectangular spin block having two opposite sides, said block including a spin plate having a plurality of ducts extending therethough, a cover plate overlying said spin plate, and cavity means disposed between the opposing faces of said spin plate and cover plate and communicating with said ducts so as to be adapted for supplying a molten polymer or the like thereto, a pair of side plates disposed along respective opposite sides of said spin block, means operatively mounting said side plates to said spin block such that said side plates may each be moved in a lateral direction toward or away from the associated side of said spin block, and cooperating surface means on said spin block and each of said side plates for causing said spin plate and cover plate to be pressed toward each other upon said side plates being laterally moved in a tightening direction by said side plate mounting means, to thus oppose the tendency of the plates to separate by reason of the pressure of the molten polymer or the like in said cavity means, and to thereby avoid leakage.

2. The melt spinning apparatus as defined in claim 1 wherein the opposing inner faces of said spin plate and cover plate define a transverse plane therebetween, and said plates further include oppositely directed outer faces; and wherein said cooperating surface means comprises a side edge surface portion extending along each of the two outer side edges of each of said two outer faces, with the two side edge surface portions of at least one of said outer faces being inclined in opposite directions with respect to said transverse plane, and contact surfaces on said side plates overlying and conforming to the inclination of respective ones of said side edge surface portions.

3. The melt spinning apparatus as defined in claim 2 wherein said inclined side edge surface portions are inclined at an angle with respect to said transverse plane which has a tangent which is not greater than the coefficient of friction of the materials of the spin plate and/or cover plate, and side plates.

4. The melt spinning apparatus as defined in claim 2 wherein said two side edge surface portions of both of said outer faces are inclined in opposite directions and at substantially equal angles with respect to said transverse plane.

5. The melt spinning apparatus as defined in claim 4 wherein the two side edge surface portions on each of said opposite sides of said spin block are inclined in opposite directions and at substantially equal angles with respect to said transverse plane.

6. The melt spinning apparatus as defined in claim 2 wherein said inclined side edge surface portions are inclined at an angle with respect to said transverse plane which has a tangent not greater than about 0.3.

7. The melt spinning apparatus as defined in claim 2 wherein the two side edge surface portions on one of said outer faces are inclined in opposite directions with respect to said transverse plane, and the two side edge surface portions on the other of said outer faces are substantially parallel to said transverse plane.

8. A melt spinning apparatus adapted for dividing a molten polymer into a plurality of streams to form synthetic filaments, and characterized by the substantial absence of leakage of the polymer, and comprising a generally rectangular spin block having two opposite sides, said block including a spin plate having a plurality of ducts extending therethrough, and a cover plate overlying said spin plate, said spin plate and cover plate having opposing inner faces defining a transverse plane therebetween and oppositely directed outer faces, each outer face including a side edge surface portion extending along each of the two side edges thereof, with the two side edge surface portions of at least one of the outer faces being inclined in opposite directions with respect to said transverse plane, said block further including cavity means disposed between the opposing faces of said spin plate and cover plate and communicating with said ducts so as to be adapted for supplying a molten polymer or the like thereto, a pair of side plates disposed along respective opposite sides of said spin block, each of said plates including a pair of laterally extending shoulders, with each shoulder having a contact surface overlying a respective side edge surface portion of said spin plate and cover plate, and with the contact surfaces of said shoulders conforming to the inclination of the associated side edge surface portions, and means operatively mounting said side plates to said spin block such that said side plates may be moved in a lateral direction toward or away from the associated side of said spin block, and such that upon lateral movement in a tightening direction the inclined side edge surface portions and cooperating contact surfaces act to bias the opposing faces of said spin plate and cover plate toward each other and thus oppose the tendency of the plates to separate by reason of the pressure of the molten polymer or the like in said cavity means, and to thereby avoid leakage.

9. The melt spinning apparatus as defined in claim 8 wherein the two side edge surface portions on both of said outer faces are inclined in opposite directions with respect to said transverse plane, and wherein the two side edge surface portions along each side of said block are inclined in opposite directions to define a wedge-like configuration in cross section.

10. The melt spinning apparatus as defined in claim 9 wherein said means operatively mounting said side plates comprises laterally directed threaded members interconnecting each side plate to the adjacent side of said spin block.

11. The melt spinning apparatus as defined in claim 8 wherein the two side edge surface portions on both of said outer faces are inclined in opposite directions with respect to said transverse plane, and wherein the two side edge portions along each side of said block are inclined in the same direction.

12. The melt spinning apparatus as defined in claim 11 wherein said means operatively mounting said side plates comprises at least one threaded member extending laterally between said side plates and transversely spaced from said spin block.

13. The melt spinning apparatus as defined in claim 8 wherein each of the inclined side edge surface portions is inclined at an angle with respect to said transverse plane whose tangent is not greater than the coefficient of friction of the materials of said spin block and side plates.

14. The melt spinning apparatus as defined in claim 8 wherein said cavity means comprises a chamber formed in said inner face of said spin plate, and wherein the inner face of said spin plate includes a projecting tongue disposed about the periphery of said chamber, and the inner face of said cover plate includes a mating recess for receiving said tongue upon the inner faces being moved together, and so as to preclude outward bulging of said spin plate from the pressure of said molten polymer in said chamber.

15. The melt spinning apparatus as defined in claim 14 wherein the adjacent side edges of said tongue and recess are correspondingly inclined so as to form a wedging interengagement upon the opposing inner faces being moved together.

16. The melt spinning apparatus as defined in claim 8 wherein said spin block further includes a distributor plate disposed between said spin plate and cover plate.

* * * * *